US009848711B2

(12) United States Patent
Kilgore et al.

(10) Patent No.: US 9,848,711 B2
(45) Date of Patent: Dec. 26, 2017

(54) MATTRESS ASSEMBLY

(71) Applicant: Tempur-Pedic Management, LLC, Lexington, KY (US)

(72) Inventors: Tyler W. Kilgore, Kingsport, TN (US); Christopher Arendoski, Gross Pointe Farms, MI (US); Mohamed F. Alzoubi, Johnson City, TN (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/654,867

(22) PCT Filed: Dec. 28, 2012

(86) PCT No.: PCT/US2012/071962
§ 371 (c)(1),
(2) Date: Jun. 23, 2015

(87) PCT Pub. No.: WO2014/105037
PCT Pub. Date: Jul. 3, 2014

(65) Prior Publication Data

US 2015/0335163 A1 Nov. 26, 2015

(51) Int. Cl.

| | |
|---|---|
| ***A47C 27/05*** | (2006.01) |
| ***A47C 27/06*** | (2006.01) |
| ***A47C 27/20*** | (2006.01) |
| ***A47C 27/14*** | (2006.01) |
| ***A47C 27/15*** | (2006.01) |

(52) U.S. Cl.
CPC ..... *A47C 27/056* (2013.01); *A47C 27/06* (2013.01); *A47C 27/148* (2013.01); *A47C 27/15* (2013.01); *A47C 27/20* (2013.01)

(58) Field of Classification Search
CPC ..... A47C 27/056; A47C 27/06; A47C 27/148; A47C 27/15; A47C 27/20; A47C 27/061; A47C 27/062
See application file for complete search history.

(56) References Cited

U.S. PATENT DOCUMENTS

| | | | | |
|---|---|---|---|---|
| 912,456 A * | 2/1909 | Fischman | ..... | A47C 27/064 5/720 |
| 2,194,569 A * | 3/1940 | Rumpf | ..... | A47C 27/144 5/654.1 |
| 2,309,570 A * | 1/1943 | Borisch | ..... | B60N 2/7052 267/84 |

(Continued)

FOREIGN PATENT DOCUMENTS

EP 0228350 A3 1/1988

OTHER PUBLICATIONS http://www.merriam-webster.com/dictionary/enhance, "Enhance-Definition", Oct. 2011.*

(Continued)

*Primary Examiner* — Eric J Kurilla
(74) *Attorney, Agent, or Firm* — Middleton Reutlinger

(57) ABSTRACT

A mattress assembly includes a first layer of viscoelastic foam defining an upper surface, and a second layer of non-viscoelasiic foam supporting the first layer. The mattress assembly also includes a plurality of static spring elements positioned beneath the upper surface for enhancing a firmness of the combined first and second layers.

14 Claims, 5 Drawing Sheets

(56) References Cited

U.S. PATENT DOCUMENTS 2,359,003 A * 9/1944 Sawyer ..... A47C 27/063 267/84
2,398,237 A * 4/1946 Marsack ..... A47C 27/20 267/84
2,446,775 A * 8/1948 Marsack ..... A47C 27/064 5/718
2,540,441 A * 2/1951 Gordon ..... A47C 27/20 5/720
2,882,959 A * 4/1959 Burkart ..... A47C 27/20 267/84
2,925,856 A * 2/1960 Gleason ..... A47C 27/20 267/84
3,049,730 A * 8/1962 Wall ..... A47C 7/20 297/452.51
3,083,380 A * 4/1963 Adler ..... A47C 27/00 297/452.21
3,099,021 A * 7/1963 Wetzler ..... A47C 27/064 264/46.2
3,099,518 A * 7/1963 Wetzler ..... B68G 11/06 156/79
3,310,819 A * 3/1967 Morrison ..... A47C 27/15 267/143
3,325,834 A * 6/1967 Lovette ..... A47C 27/20 264/109
3,401,411 A * 9/1968 Morrison ..... A47C 7/18 297/452.51
3,626,523 A * 12/1971 Robins ..... A47C 27/062 267/92
3,818,560 A * 6/1974 Bulloch, Jr. ..... A47C 27/04 29/91.1
4,154,786 A * 5/1979 Plasse ..... A47C 27/20 249/64
4,429,427 A * 2/1984 Sklar ..... A47C 27/20 5/654.1
4,520,517 A * 6/1985 Ahlm ..... A47C 27/15 297/DIG. 1
4,862,540 A * 9/1989 Savenije ..... A47C 27/20 5/655.7
5,327,596 A 7/1994 Wallace et al.
5,669,094 A * 9/1997 Swanson ..... A47C 27/14 5/740
5,937,464 A * 8/1999 Niederman ..... A47C 27/20 5/718
6,159,574 A * 12/2000 Landvik ..... A47C 27/15 428/213
6,317,912 B1 * 11/2001 Graebe ..... A47C 23/047 5/655.3
6,484,338 B1 * 11/2002 Hagglund ..... A47C 27/05 5/654.1
6,694,554 B2 * 2/2004 Bullard ..... A47C 23/05 156/252
6,944,899 B2 * 9/2005 Gladney ..... A47C 23/043 267/180
7,125,465 B2 * 10/2006 Bullard ..... A47C 23/05 156/182
7,428,764 B2 * 9/2008 Clark ..... A47C 27/20 5/655.9
7,469,437 B2 * 12/2008 Mikkelsen ..... A47C 7/022 5/655.9
7,496,981 B2 3/2009 Alonso Cucurull
7,520,012 B2 * 4/2009 Robins ..... A47C 27/144 5/724
2002/0162173 A1 * 11/2002 Formenti ..... A47C 27/148 5/718
2002/0166174 A1 * 11/2002 Bullard ..... A47C 23/05 5/655.7
2003/0229943 A1 * 12/2003 Lewis ..... A47C 23/047 5/716
2004/0003471 A1 * 1/2004 VanSteenburg ..... A47C 27/081 5/709
2004/0025258 A1 * 2/2004 Van Der Wurf ..... A47C 27/144 5/718
2004/0103479 A1 * 6/2004 Mossbeck ..... A47C 23/0433 5/720
2004/0128773 A1 * 7/2004 Barber ..... A47C 27/062 5/716
2004/0133988 A1 * 7/2004 Barber ..... A47C 27/064 5/716
2004/0172766 A1 * 9/2004 Formenti ..... A47C 27/148 5/718
2005/0005354 A1 * 1/2005 Gladney ..... A47C 23/043 5/256
2005/0039264 A1 * 2/2005 Barman ..... A47C 27/053 5/717
2005/0084667 A1 * 4/2005 Landvik ..... A47C 27/15 428/316.6
2005/0115003 A1 * 6/2005 Torbet ..... A47C 27/082 5/727
2005/0257323 A1 * 11/2005 Edling ..... A47C 27/062 5/720
2006/0162087 A1 * 7/2006 Chang ..... A47C 27/20 5/724
2006/0288490 A1 * 12/2006 Mikkelsen ..... A47C 7/022 5/740
2007/0232172 A1 * 10/2007 Biermann ..... A47C 7/18 442/221
2008/0083069 A1 * 4/2008 Dell'Accio ..... A47C 27/053 5/740
2008/0093784 A1 * 4/2008 Rawls-Meehan ..... A47C 7/027 267/80
2008/0109965 A1 * 5/2008 Mossbeck ..... A47C 23/047 5/713
2008/0184492 A1 * 8/2008 Sunde ..... A47C 27/053 5/717
2008/0189867 A1 * 8/2008 Wieland ..... A47C 23/05 5/719
2009/0100606 A1 * 4/2009 An ..... A47C 27/001 5/716
2010/0139006 A1 * 6/2010 Kilic ..... A47C 27/062 5/720
2010/0223732 A1 * 9/2010 Allman ..... A42B 3/128 5/717
2010/0227091 A1 * 9/2010 Pearce ..... A47C 27/056 428/36.1
2011/0041252 A1 2/2011 Defranks et al.
2011/0191962 A1 * 8/2011 Frame ..... A47C 27/062 5/717
2011/0197368 A1 * 8/2011 Tarazona De La Asuncion ..... A47C 27/148 5/690
2011/0252562 A1 * 10/2011 Mikkelsen ..... A47C 21/042 5/421
2011/0256369 A1 * 10/2011 Switzer ..... A47C 27/001 428/215
2011/0256380 A1 * 10/2011 Chandler ..... A47C 27/085 428/316.6
2011/0283461 A1 * 11/2011 Rasmussen ..... A47C 27/146 5/731
2011/0302721 A1 * 12/2011 Khambete ..... A47C 27/06 5/716
2012/0096649 A1 * 4/2012 Fukano ..... A47C 23/043 5/720
2012/0102657 A1 5/2012 Wildeman
2012/0102658 A1 * 5/2012 Mantzis ..... A47C 27/062 5/720
2012/0167308 A1 * 7/2012 Van Lear ..... A47C 27/085 5/655.5
2013/0152305 A1 * 6/2013 Lall ..... A47C 27/122 5/400
2013/0269115 A1 * 10/2013 Bader ..... A47C 23/04 5/718
2014/0075678 A1 * 3/2014 Murphy ..... A47C 31/001 5/698
2014/0082843 A1 * 3/2014 Papadakos ..... A47C 19/021 5/618
2014/0304921 A1 * 10/2014 Collins ..... A47C 27/15 5/727

(56) References Cited

U.S. PATENT DOCUMENTS

| | | | | |
|---|---|---|---|---|
| 2014/0325763 | A1* | 11/2014 | Mason | A47C 27/085 5/652.1 |
| 2015/0157136 | A1* | 6/2015 | Alzoubi | A47C 27/15 5/718 |
| 2015/0182031 | A1* | 7/2015 | Jensen | A47G 9/0238 5/690 |
| 2015/0296994 | A1* | 10/2015 | Mikkelsen | A47C 21/042 5/655.4 |

OTHER PUBLICATIONS

Patent Cooperation Treaty, International Search Report and Written Opinion, dated Aug. 21, 2013, 13 pgs.

* cited by examiner

MATTRESS ASSEMBLY

FIELD OF THE INVENTION

The present invention relates to mattress assemblies, and more particularly to mattress assemblies for use in beds.

BACKGROUND OF THE INVENTION

Mattress assemblies are typically used in a bed to support a user's body or a portion thereof (e.g., head, shoulders, legs, etc.) while the user is at rest. Some mattress assemblies include multiple foam layers. Such mattress assemblies can be costly to manufacture and heavy. Conventional mattress assemblies can also differ in firmness and comfort feel by adjusting the number, thickness and composition of the constituent foam layers.

SUMMARY OF THE INVENTION

The invention provides, in one aspect, a mattress assembly including a first layer of viscoelastic foam defining an upper surface, and a second layer of non-viscoelastic foam supporting the first layer. The mattress assembly also includes a plurality of static spring elements positioned beneath the upper surface for enhancing a firmness of the combined first and second layers.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
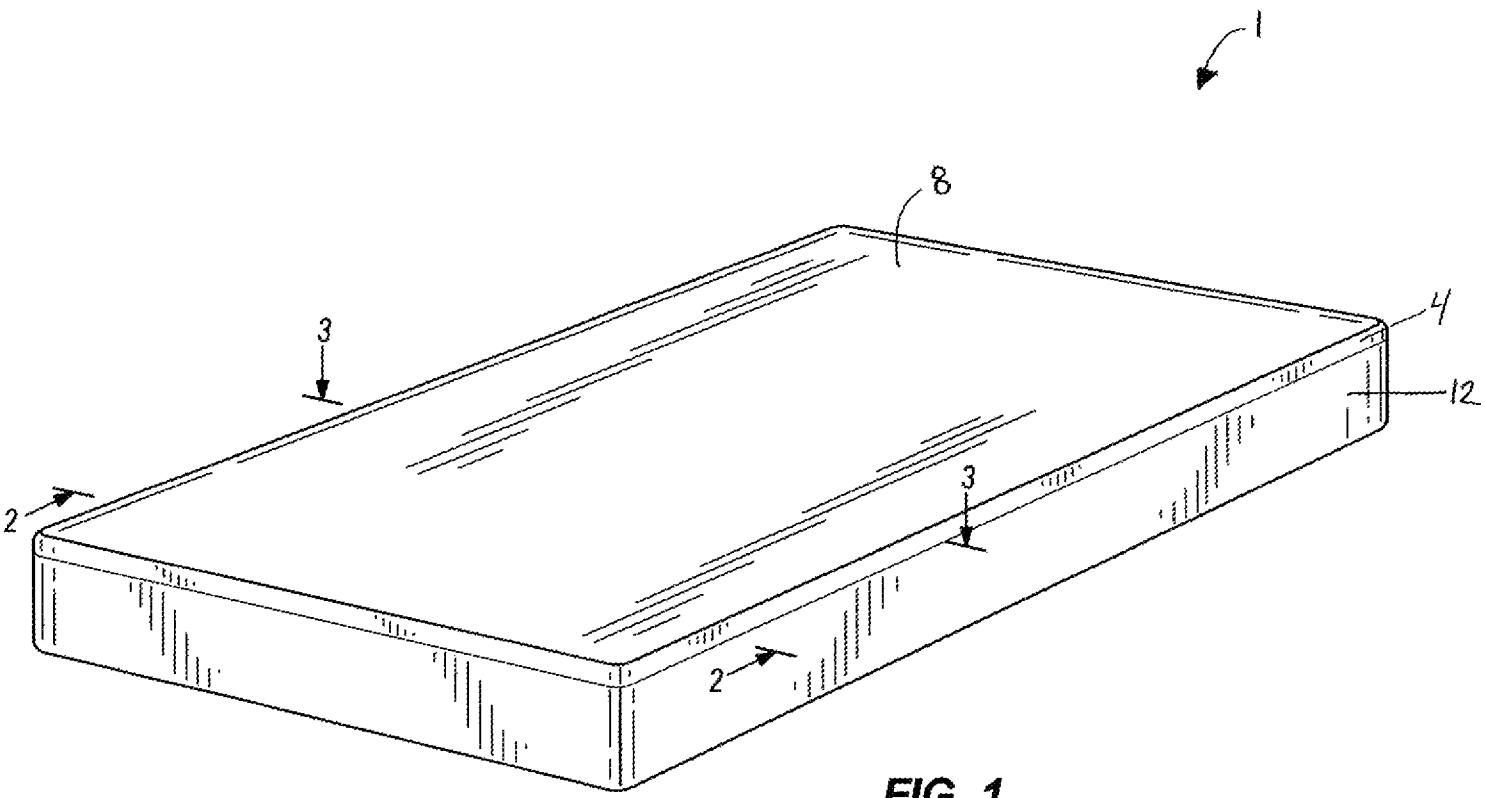
FIG. 1 is a perspective view of a mattress assembly in accordance with an embodiment of the invention.
Figure 2:
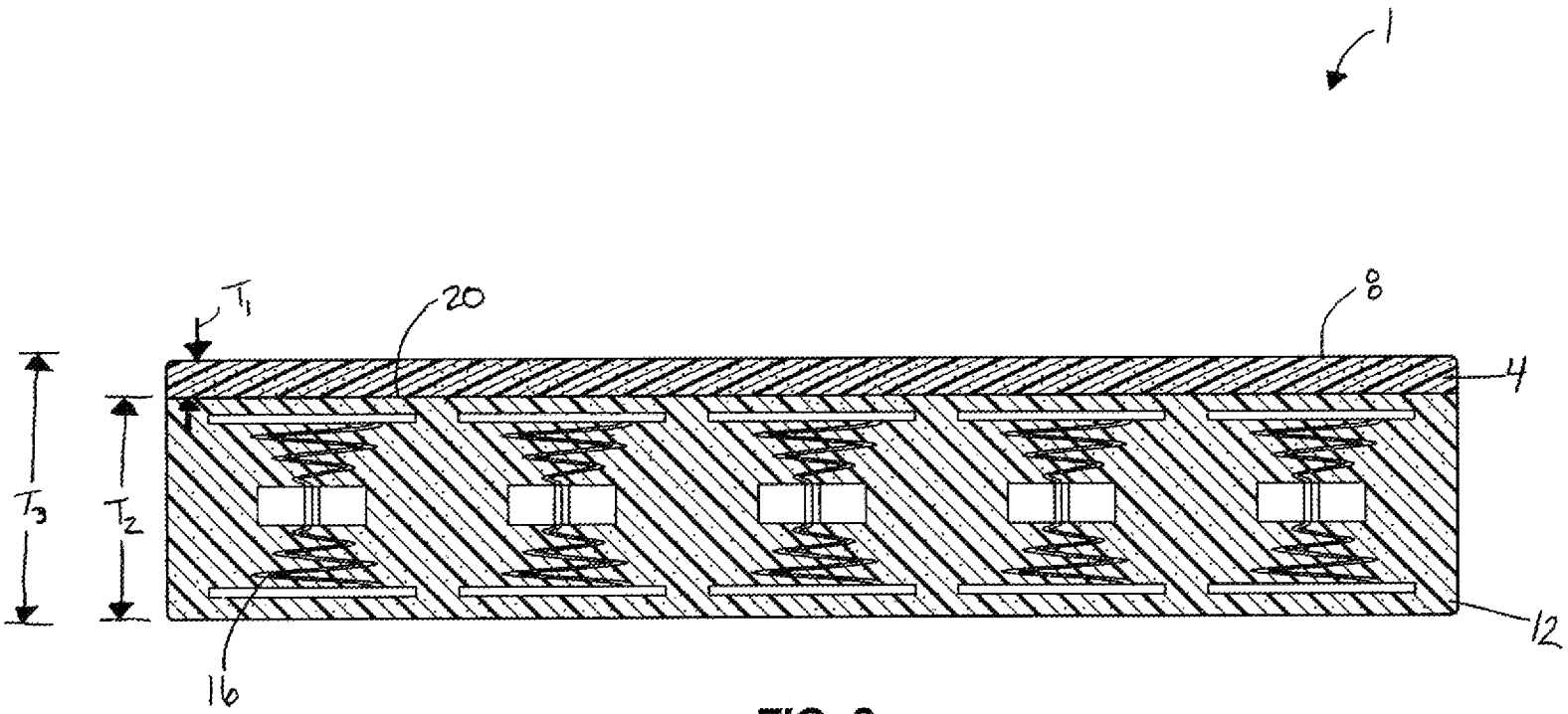
FIG. 2 is a cross-sectional view of the mattress assembly of FIG. 1, taken along line 2-2 in FIG. 1.

FIG. 1 illustrates a mattress assembly 1 for use in a bed. The mattress assembly 1 includes a first layer 4 of viscoelastic foam defining an upper surface 8 of the mattress assembly 1 and having a thickness $T_1$ (FIG. 2). Viscoelastic foam is sometimes referred to as "memory foam" or "low resilience foam." Coupled with the slow recovery characteristic of the viscoelastic foam, the first layer 4 can at least partially conform to the user's body or body portion (hereinafter referred to as "body"), thereby distributing the force applied by the user's body upon the viscoelastic foam layer 4. The viscoelastic foam layer 4 can provide a relatively soft and comfortable surface for the user's body.

The viscoelastic foam layer 4 has a hardness of at least about 20 N and no greater than about 80 N for desirable softness and body-conforming qualities. Alternatively, the viscoelastic foam layer 4 may have a hardness of at least about 30 N and no greater than about 70 N. In still other alternative embodiments, the viscoelastic foam layer 4 may have a hardness of at least about 40 N and no greater than about 60 N. Unless otherwise specified, the hardness of a material referred to herein is measured by exerting pressure from a plate against a sample of the material to a compression of 40 percent of an original thickness of the material at approximately room temperature (e.g., 21 to 23 degrees Celsius). The 40 percent compression is held for a set period of time, following the International Organization of Standardization (ISO) 2439 hardness measuring standard.

With continued reference to FIG. 1, the viscoelastic foam layer 4 can also have a density providing a relatively high degree of material durability. The density of the viscoelastic foam layer 4 can impact other characteristics of the foam, such as the manner in which the viscoelastic foam layer 4 responds to pressure, and the feel of the viscoelastic foam layer 4. In the illustrated embodiment, the viscoelastic foam layer 4 has a density of no less than about 30 $kg/m^3$ and no greater than about 150 $kg/m^3$. Alternatively, the viscoelastic foam layer 4 may have a density of at least about 40 $kg/m^3$ and no greater than about 135 $kg/m^3$. In still other alternative embodiments, the viscoelastic foam layer 4 may have a density of at least about 50 $kg/m^3$ and no greater than about 120 $kg/m^3$.

The viscoelastic foam layer 4 can be made from non-reticulated or reticulated viscoelastic foam. Reticulated viscoelastic foam has characteristics that are well suited for use in the mattress assembly, including the enhanced ability to permit fluid movement through the reticulated viscoelastic foam, thereby providing enhanced air and/or heat movement within, through, and away from the viscoelastic foam layer 4 of the mattress assembly 1. Reticulated foam is a cellular foam structure in which the cells of the foam are essentially skeletal. In other words, the cells of the reticulated foam are each defined by multiple apertured windows surrounded by struts. The cell windows of the reticulated foam can be entirely gone (leaving only the cell struts) or substantially gone. For example, the foam may be considered "reticulated" if at least 50 percent of the windows of the cells are missing (i.e., windows having apertures therethrough, or windows that are completely missing and therefore leaving only the cell struts). Such structures can be created by destruction or other removal of cell window material, or preventing the complete formation of cell windows during the manufacturing process.

With reference to FIG. 1, the mattress assembly 1 also includes a second layer 12 of non-viscoelastic foam supporting the viscoelastic foam layer 4. The non-viscoelastic foam layer 12 has a thickness $T_2$ that is greater than the thickness $T_1$ of the viscoelastic foam layer 4. Alternatively, the thickness $T_2$ of the non-viscoelastic foam layer 12 may be the same or less than the thickness $T_1$ of the viscoelastic foam layer 4. The non-viscoelastic foam layer 12 may be a latex foam or a high-resilience (HR) polyurethane foam. Such a latex foam has a hardness of at least about 30 N and no greater than about 130 N for a desirable overall mattress assembly firmness and "bounce." Alternatively, the latex foam may have a hardness of at least about 40 N and no greater than about 120 N, or at least about 50 N and no greater than about 110 N. The latex foam has a density of no less than about 40 kg/m$^3$ and no greater than about 100 kg/m$^3$. In still other alternative embodiments, the latex foam may have a density of at least about 50 kg/m$^3$ and no greater than about 100 kg/m$^3$, or at least about 60 kg/m$^3$ and no greater than about 100 kg/m$^3$.

In embodiments of the mattress assembly 1 in which the non-viscoelastic foam layer 12 includes HR polyurethane foam, such a foam can include an expanded polymer (e.g., expanded ethylene vinyl acetate, polypropylene, polystyrene, or polyethylene), and the like. The HR polyurethane foam has a hardness of at least about 80 N and no greater than about 200 N for a desirable overall cushion firmness and "bounce." Alternatively, the HR polyurethane foam may have a hardness of at least about 90 N and no greater than about 190 N, or at least about 100 N and no greater than about 180 N. The FIR polyurethane foam has a density, which provides a reasonable degree of material durability to the non-viscoelastic foam layer 12. The HR polyurethane foam can also impact other characteristics of the non-viscoelastic foam layer 12, such as the manner in which the non-viscoelastic foam layer 12 responds to pressure. The FIR polyurethane foam has a density of no less than about 10 kg/m$^3$ and no greater than about 80 kg/m$^3$. In still other alternative embodiments, the HR polyurethane foam may have a density of no less than about 15 kg/m$^3$ and no greater than about 70 kg/m$^3$, or no less than about 20 kg/m$^3$ and no greater than about 60 kg/m$^3$.

Figure 3:
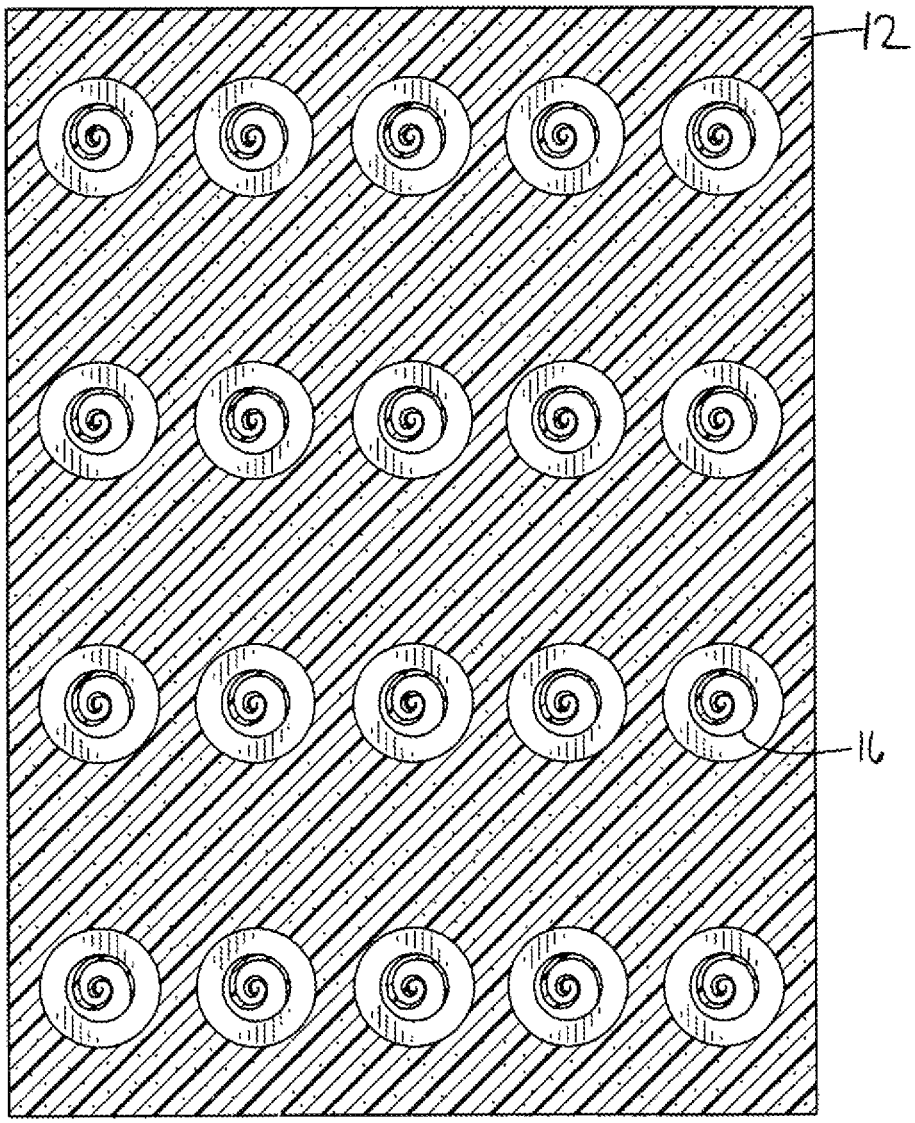
FIG. 3 is a cross-sectional view of the mattress assembly of FIG. 1, taken along line 3-3 in FIG. 1.

With reference to FIGS. 2 and 3, the mattress assembly 1 further includes multiple static spring elements 16 positioned beneath the upper surface 8 of the mattress assembly 1 for enhancing a firmness of the combined viscoelastic and non-viscoelastic foam layers 4, 12. Particularly, the spring elements 16 are embedded into the non-viscoelastic foam layer 12 using a molding process, and the viscoelastic foam layer 4 is attached to the upper surface 20 of the non-viscoelastic foam layer 12 (e.g., using adhesives, etc.). In the illustrated embodiment the spring elements 16 are aligned with a thickness $T_3$ of the mattress assembly 1 and are entirely encased within the non-viscoelastic foam layer 12 (FIG. 2). In other words, each spring element 16 is separated or isolated from adjacent spring elements 16 by the non-viscoelastic foam layer 12. Alternatively, the spring elements 16 may be partially encased within the non-viscoelastic foam layer 12 and covered by the viscoelastic foam layer 4 such that the spring elements 16 may be positioned between the viscoelastic and non-viscoelastic foam layers 4, 12.

The spring elements 16 are arranged in an array having multiple rows and multiple columns (FIG. 3). The array can be in the form of a grid, in which the spring elements 16 are spaced across a portion or all of the width and length of the mattress assembly 1. In such cases, consecutive spring elements 16 extending in width-wise and length-wise directions along the mattress assembly 1 can extend substantially parallel to the width and length of the mattress assembly 1. Alternatively, consecutive spring elements 16 may extend diagonally with respect to the width and length of the mattress assembly 1. In other words, each row may be offset or shifted relative to the preceding and/or following row. In still other alternative constructions, the spring elements 16 may be arranged randomly, in a single row, in a single column, or combinations thereof.

With continued reference to FIGS. 2 and 3, the spring elements 16 are made of a polymeric material, and more specifically, a thermoplastic material (e.g., TPEE, SBS, SEBS, TPV, etc.). The spring elements 16 are configured as coil springs having the same length. Alternatively, the spring elements 16 may be configured as leaf springs, for example, or any of a number of different types of springs. In still other alternative constructions, the spring elements 16 may include different lengths. For example, a first spring element 16 may have a different length than a second spring element 16 or a first group of spring elements 16 may have a different length than a second group of spring elements 16, and so forth. In the illustrated embodiment of the mattress assembly 1, the spring elements 16 have the same spring rates. Alternatively, the spring elements 16 may have different spring rates. For example, a first spring element 16 may have a different spring rate than a second spring element 16 or a first group of spring elements 16 may have a different spring rate than a second group of spring elements 16, and so forth.

The spring rate of the spring elements 16 can be a constant spring rate or a variable spring rate. Spring elements 16 including a constant spring rate often have the same or a constant spacing between coils of the spring element 16 as compared to a variable spring rate, in which the spacing between the coils is different or variable.

In some embodiments of the mattress assembly 1, the firmness of the combined viscoelastic and non-viscoelastic foam layers 4, 12 can be enhanced substantially uniformly across the width and length of the mattress assembly 1. Alternatively, the firmness of the combined viscoelastic and non-viscoelastic foam layers 4, 12 can be enhanced non-uniformly across the width and length of the mattress assembly 1. For example, the non-uniform firmness of the mattress assembly 1 may be tuned (e.g., by using different spring elements, different rate spring elements, a combination of constant and variable rate spring elements, etc.) in accordance with the locations or regions of the mattress assembly 1 normally associated with certain portions (e.g., head, shoulders, legs, etc.) of the user's body that require different support. In other words, the spring elements 16 may be selected to enhance the firmness of the combined viscoelastic and non-viscoelastic foam layers 4, 12 a greater amount in regions of the mattress assembly 1 associated with a reclined user's lower legs, posterior, and head/neck, for example.

With continued reference to FIGS. 2 and 3, the spring elements 16 have the same wire thickness, density, shape, and ring size. However, in alternative embodiments of the mattress assembly 1, the wire thickness, density, shape, ring size, or combinations thereof may be altered to more or less enhance the firmness of the combined viscoelastic and non-viscoelastic foam layers 4, 12.

When using the mattress assembly 1, the user's body contacts the upper surface 8 of the mattress assembly 1. In turn, the spring elements 16 enhance the firmness of the combined viscoelastic and non-viscoelastic foam layers 4, 12 to provide comfort to the user. By replacing a portion of the non-viscoelastic foam layer 12 with the spring elements 16, the mattress assembly 1 has a lower cost and weight as compared to conventional mattress assemblies. Additionally, the mattress assembly 1 can be readily altered with respect to the comfort and feel provided to the user by altering the spring elements 16 to have a different spring rate, wire thickness, shape, and the like. In other words, the mattress assembly 1 can be manufactured in a cost-effective manner to provide users with different mattress assemblies 1 having different properties (e.g., firmness, comfort feel, etc.) by altering the spring elements 16 as compared to a conventional mattress assembly in which an entire layer or more would need be redesigned to provide a different mattress assembly to the user.

Figure 4:
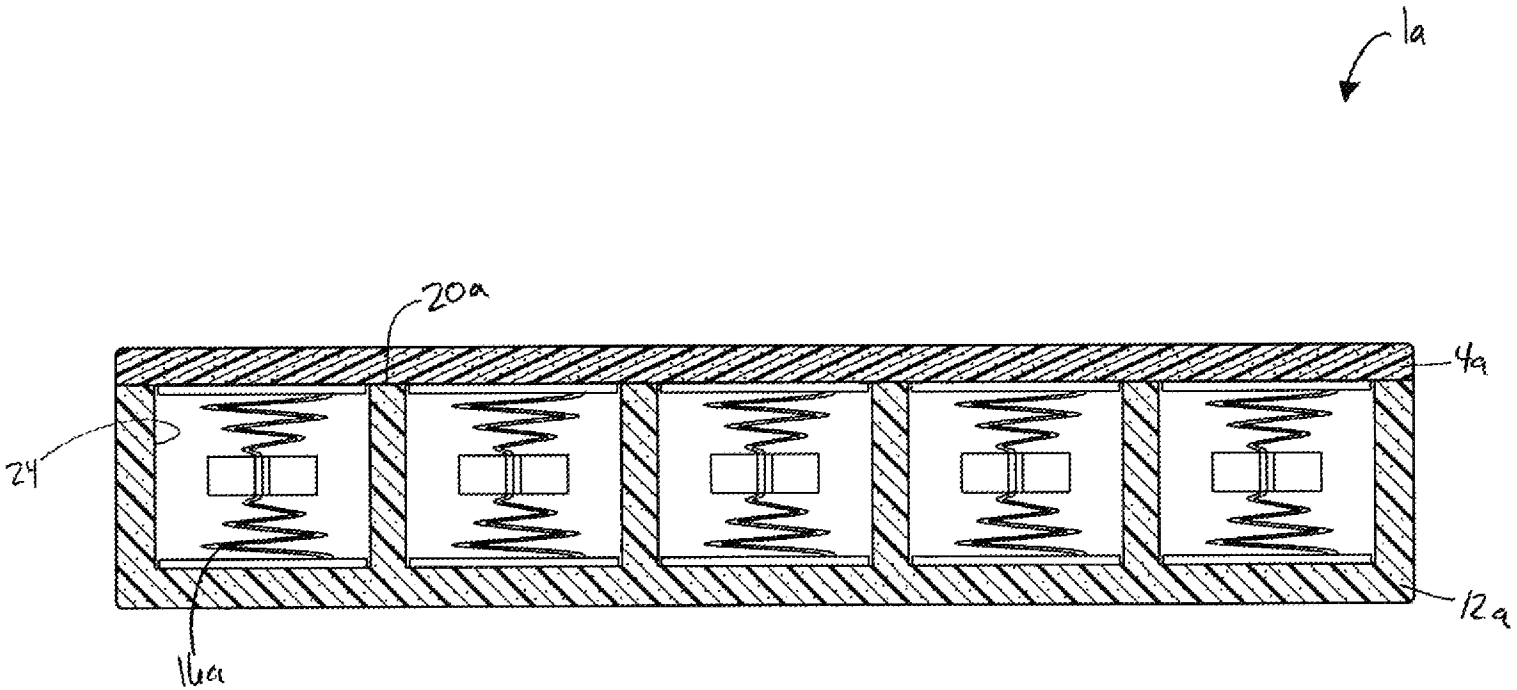
FIG. 4 is a cross-sectional view, similar to that of FIG. 2, of a mattress assembly in accordance with another embodiment of the invention.
Figure 5:
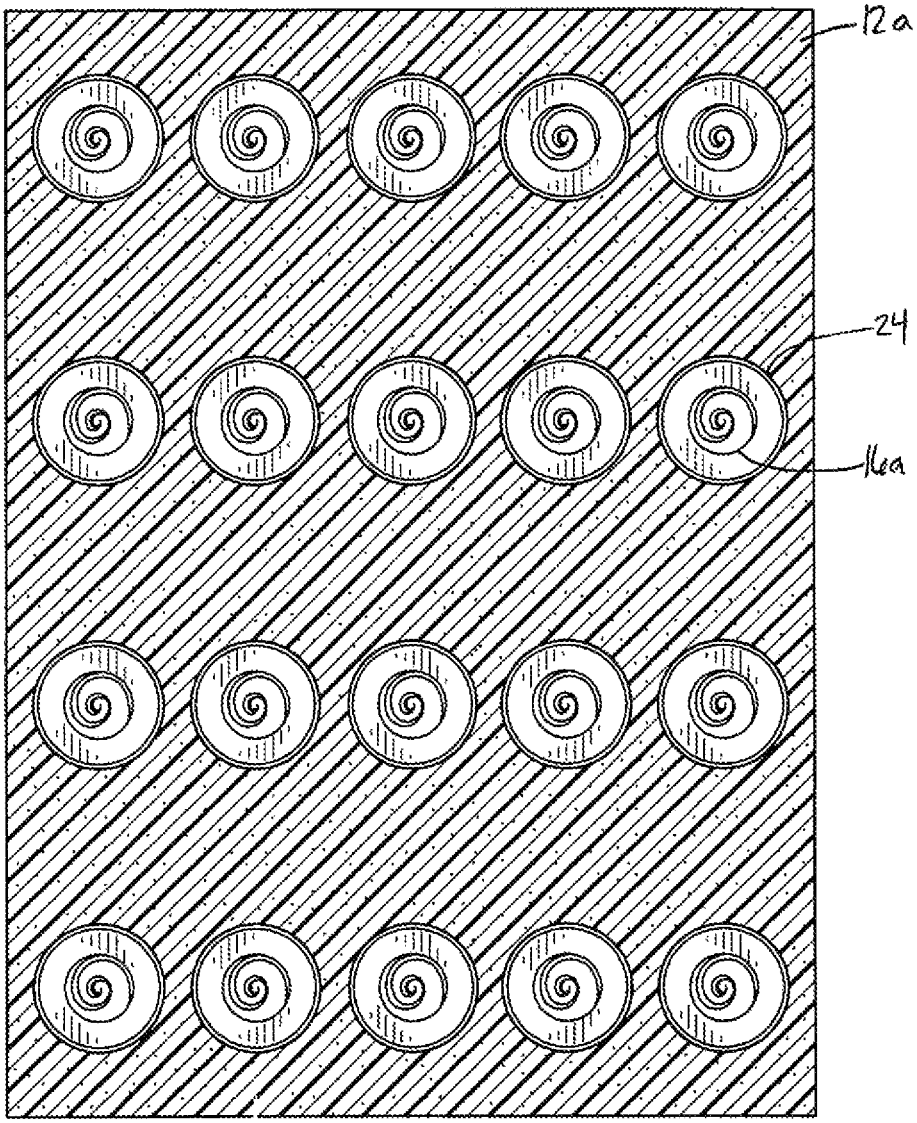
FIG. 5 is a cross-sectional view, similar to that of FIG. 3, of the mattress assembly of FIG. 4.

FIGS. 3 and 4 illustrate a second embodiment of the mattress assembly 1*a* used in connection with beds. Like components are identified with like reference numerals with the letter "a," and will not be described again in detail. Rather than embedding the spring elements 16 into the non-viscoelastic foam layer 12 like that shown in FIGS. 2 and 3 and described above, the mattress assembly 1*a* includes spring elements 16*a* positioned within discrete cavities 24 within the non-viscoelastic foam layer 12*a*. The cavities 24 can be formed in the non-viscoelastic foam layer 12*a* by a drilling process or a cutting process, for example. The spring elements 16*a* are placed or positioned within the cavities 24, and the viscoelastic foam layer 4*a* is attached or fastened to the upper surface 20*a* of the non-viscoelastic foam layer 12*a* (e.g., using adhesives, etc.).

The mattress assembly 1*a* is used in an identical fashion as the mattress assembly 1 shown in FIGS. 2 and 3.

Various features of the invention are set forth in the following claims.

What is claimed is:

1. A mattress assembly comprising:

a first layer of viscoelastic foam defining an upper surface;

a second layer of non-viscoelastic foam supporting the first layer; and a plurality of independent static spring elements positioned beneath the upper surface, the second layer of non-viscoelastic foam molded around and through each of the plurality of static spring elements, and the second layer having a thickness greater than a height of each of the plurality of static spring elements, wherein the plurality of independent static spring elements are embedded and entirely encased within the second layer of non-viscoelastic foam to thereby substantially increase a firmness of the combined first and second layers, and wherein an upper portion of the second layer extends continuously above each of the plurality of static spring elements, and a lower portion of the second layer extends continuously below each of the plurality of static spring elements.

2. The mattress assembly of claim 1, wherein the viscoelastic foam includes a hardness of at least about 20 N and no greater than about 80 N.

3. The mattress assembly of claim 1, wherein the viscoelastic foam includes a density of no less than about 30 $kg/m^3$ and no, greater than about 150 $kg/m^3$.

4. The mattress assembly of claim 1, wherein the second layer of non-viscoelastic foam is one of a latex foam and a high-resilience polyurethane foam.

5. The mattress assembly of claim 4, wherein the latex foam includes a hardness of at least about 30 N and no greater than about 130 N, or wherein the high-resilience polyurethane foam includes a hardness of at least about 80 N and no greater than about 200 N.

6. The mattress assembly of claim 4, wherein the latex foam includes a density of no less than about 40 $kg/m^3$ and no greater than about 100 $kg/m^3$, or wherein the high-resilience polyurethane foam includes a density of no less than about 10 $kg/m^3$ and no greater than about 80 $kg/m^3$.

7. The mattress assembly of claim 1, wherein the plurality of static spring elements are made of a polymeric material.

8. The mattress assembly of claim 7, wherein the plurality of static spring elements are made of a thermoplastic material.

9. The mattress assembly of claim 1, wherein the plurality of static spring elements are aligned with a thickness of the mattress assembly.

10. The mattress assembly of claim 1, wherein first and second spring elements of the plurality of static spring elements include different spring rates.

11. The mattress assembly of claim 1, wherein at least one of the plurality of static spring elements includes a constant spring rate.

12. The mattress assembly of claim 1, wherein at least one of the plurality of static spring elements includes a variable spring rate.

13. The mattress assembly of claim 1, wherein the plurality of static spring elements are configured as coil springs.

14. The mattress assembly of claim 1, wherein the plurality of static spring elements are arranged in an array having a plurality of rows and a plurality of columns.

* * * * *